US006862770B2

(12) United States Patent
Severson

(10) Patent No.: US 6,862,770 B2
(45) Date of Patent: Mar. 8, 2005

(54) WINDOW TREATMENT CLEANING TOOL

(76) Inventor: Lynn B. Severson, 1405 Rock Ridge Ct., Colorado Springs, CO (US) 80918

( * ) Notice: Subject to any disclaimer, the term of this patent is extended or adjusted under 35 U.S.C. 154(b) by 0 days.

(21) Appl. No.: 10/402,591

(22) Filed: Mar. 28, 2003

(65) Prior Publication Data

US 2003/0226226 A1 Dec. 11, 2003

Related U.S. Application Data

(60) Provisional application No. 60/369,058, filed on Apr. 1, 2002.

(51) Int. Cl.[7] ..... A46B 5/02; A47L 13/00

(52) U.S. Cl. ..... 15/104.002; 15/144.4

(58) Field of Search ..... 15/104.002, 143.1, 15/144.4, 220.3

(56) References Cited

U.S. PATENT DOCUMENTS 1,785,512 A * 12/1930 Buttenheim ..... 15/210.1
5,924,157 A * 7/1999 Barela ..... 15/104.002
6,175,984 B1 * 1/2001 Prime et al. ..... 15/104.002
6,240,590 B1 * 6/2001 Nesbit ..... 15/210.1

* cited by examiner

*Primary Examiner*—Randall Chin
(74) *Attorney, Agent, or Firm*—Linda T. Jaron, Esq.

(57) ABSTRACT

A cleaning tool for removing debris from a cellular window treatment having one or more cells, each cell having a width. The tool comprises a handle for gripping the tool and a wand portion attached to the handle. The wand portion has a first telescoping section of a first diameter, a second telescoping section of a second diameter, and a third telescoping section of a third diameter. The first diameter is less than the cell width, the second diameter is less than the first diameter, and the third diameter is less than the second diameter. The first, second and third telescoping sections are movable between a closed collapsed position and an open, extended position. Each of the first, second and third telescoping section has an external surface. The tool further comprises a coating mounted to at least one of the external surfaces of the first, second or third telescoping section, the coating being formed from a tacky material. Preferably the handle includes at least one finger grip. The tool is used by inserting the wand portion into the at least one cell, whereupon the tacky material will touch the debris, causing the debris to be removed from the cell when the wand is removed from the cell.

11 Claims, 1 Drawing Sheet

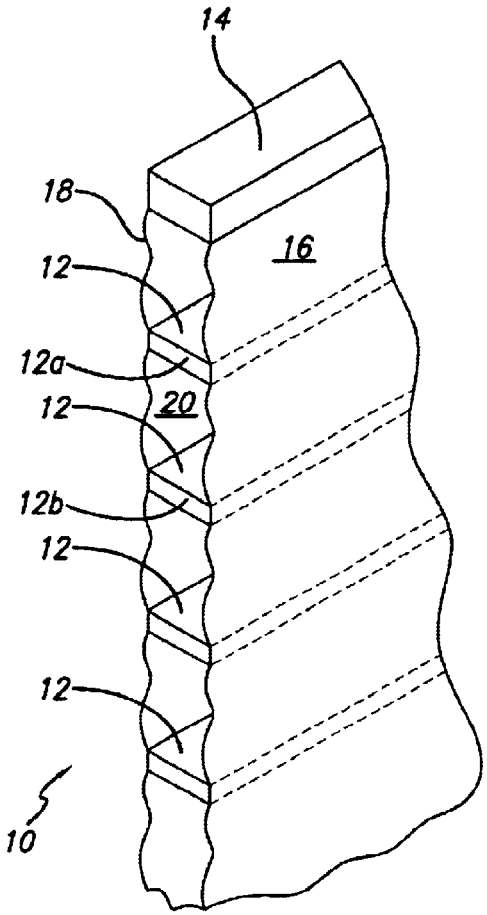
FIG. 1
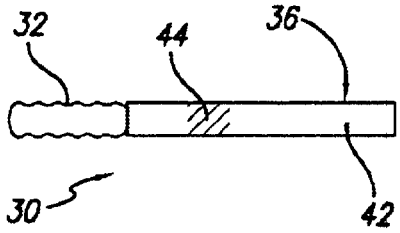
FIG. 3
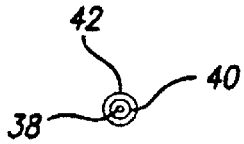
FIG. 4
FIG. 2
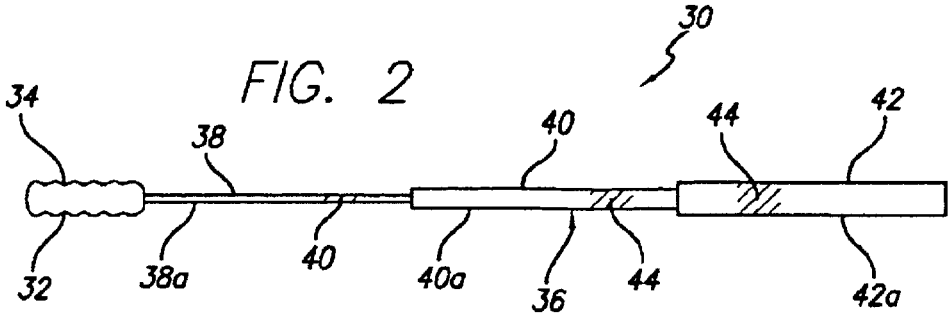

WINDOW TREATMENT CLEANING TOOL

CROSS-REFERENCE TO RELATED APPLICATIONS

This application claims the benefit under 35 U.S.C. §119 (e) of Provisional Application No. 60/369,058, entitled "Window Treatment Cleaning Tool," filed Apr. 1, 2002, by inventor Lynn B. Severson.

FIELD OF THE INVENTION

This invention relates to a cleaning tool for window treatments and, more specifically, to an expandable cleaning tool for use with window blinds or shadings, commonly sold under the trademark Silhouette® by Hunter Douglas.

BACKGROUND OF THE INVENTION

Referring to FIG. 1, a perspective view of a window blind, a Silhouette® window blind 10 is depicted mounted to the upper surface of a window frame (not shown). While blind 10 is typically mounted to the window frame in such a manner, it is to be understood that the mounting of the blind 10 to the window frame is of no importance to the present invention and can be modified without impacting the present invention in any way.

Blind 10 as depicted includes a number of vanes 12 which are configured as in a of the type which is well known in the art so as to be movable between an open horizontal position, as shown in FIG. 1, and a closed vertical position by pulling a continuous cord loop (not shown) attached to a mechanism in a header 14 of the blind. When vanes 12 are in a closed vertical position, light is blocked from the window.

Silhouette® blind 10 includes a front fabric panel 16 and a back fabric panel 18 positioned on either side of vanes 12. Preferably, fabric panels 16 and 18 are made of a sheer material to permit light to permeate fabric panels 16 and 18 when vanes 12 are in an open position.

From FIG. 1, it can be seen that a cell 20 is formed by front fabric panel 16, an upper vane 12*a,* rear fabric panel 18 and a lower vane 12*b.* Silhouette® blind 10 includes a plurality of such cells 20 extending from header 14 to the lower portion of the blind (not shown.) Cell 20 is typically of dimensions of approximately 2 or 3 inches square.

Silhouette® blind 10 is sold in various widths. Dirt and other debris, such as lint and dead insects, can be caught in cell 20. It is difficult to reach the inner parts of cell 20 to clean such debris from the cell. Because fabric panels 16 and 18 are typically sheer, this debris is unsightly and undesirable.

Typical means for cleaning cell 20 include utilizing a feather duster, employing ultrasonic cleaning, using canned air, or utilizing an upholstery cleaner on a vacuum cleaner. These methods have proven unsatisfactory and ineffective.

Accordingly, it is an object of the present invention to provide an improved cleaning tool to easily reach the interior portion of the cells of a Silhouette® blind to clean dirt and other debris therefrom.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments and its several details are capable of modifications in various respects, all without departing from the invention. Accordingly, the drawing and description are to be regarded as illustrative in nature and not as restrictive.

BRIEF DESCRIPTION OF THE DRAWINGS

FIG. 1 is a perspective view of a Silhouette® window blind or shading of the type to which the invention is directed;

FIG. 2 is a plan view of the cleaning tool in its open or extended position;

FIG. 3 is a plan view of the cleaning tool in its closed or collapsed position; and FIG. 4 is an end view of the cleaning tool.

DETAILED DESCRIPTION OF THE PREFERRED EMBODIMENT OF THE INVENTION

Referring to FIG. 2, cleaning tool 30 is depicted. Tool 30 includes a handle 32, which can be made of any material such as plastic or metal, and is preferable formed with finger grips 34. Attached to handle 32 is a telescoping wand portion 36. Wand portion 36 may be attached to handle 32 in any conventional manner, including but not limited to molding or soldering.

As shown in FIG. 2, wand portion 36 is comprised of three telescoping sections 38, 40 and 42. When tool 10 is in its closed or collapsed position, as depicted in FIG. 3, section 38 is entirely enclosed within section 40, and section 40 is entirely enclosed within section 42. This is most clearly depicted in FIG. 4, wherein it can be seen that the diameter of section 38 is less than the diameter of section 40, which is also less than the diameter of section 42. This configuration permits wand portion 36 to be easily manipulated between the open, extended position of FIG. 2 and the closed, collapsed position of FIG. 3.

Mounted on the entire length of external surfaces 38*a,* 40*a* and 42*a* of sections 38, 40 and 42, respectively, is a coating 44. Coating 44 may be of any tacky material that will cause dirt and debris deposited in the interior portion of cell 20 to adhere to wand portion 36. It thus can be seen that when tool 30 is positioned in the open, extended position of FIG. 2 and inserted into cell 20 of a Silhouette® blind 10, the tool can be caused to touch the dirt or debris deposited in the cell so that when the tool is removed from cell 20, the dirt and debris will be removed along with the tool.

While it is preferred that coating 44 be applied to each external surface 38*a,* 40*a* and 42*a,* the present invention contemplates the use of coating 44 only on external surface 42*a.*

It is to be understood that wand portion 36 may be manufactured in varying lengths to suit the width of the blind 10 being purchased by the consumer. While it is contemplated that the length of wand portion 36 not exceed 54 inches with each section 38, 40 and 42 being 19 inches in length, it is to be understood that a longer wand is feasible and within the scope of the present invention.

In this disclosure, there is shown and described only the preferred embodiment of the invention, but it is to be understood that the invention is capable of use in various other combinations and environments and is capable of changes or modifications within the scope of the invention concept as expressed herein.

What is claimed is:

1. A cleaning tool for removing debris from a window treatment, the window treatment including at least one cell, the tool comprising:

a handle for gripping the tool;

a telescoping wand portion attached to the handle and including an external surface wherein the external surface extends linearly with the telescoping wand portion; and a coating mounted to the external surface of the wand portion, the coating being formed from a tacky material;

wherein when the wand portion is inserted into the at least one cell, the tacky material will touch the debris, causing the debris to be removed from the cell when the wand is removed from the cell.

2. The cleaning tool of claim 1, wherein the wand portion is comprised of at least three telescoping sections.

3. The cleaning tool of claim 2, wherein each of the at least three telescoping sections includes an external surface, and wherein the coating is applied to each of the external surfaces.

4. The cleaning tool of claim 2, wherein at least one of the at least three telescoping sections includes an external surface, and wherein the coating is applied to the external surface.

5. The cleaning tool of claim 1, wherein the at least one cell includes a width, and the wand portion comprises:

a first telescoping section of a first diameter, the first diameter being less than the cell width, a second telescoping section of a second diameter, the second diameter being less than the first diameter; and a third telescoping section of a third diameter, the third diameter being less than the second diameter;

wherein the first, second and third telescoping sections can be movable between a closed collapsed position and an open, extended position, and wherein the first telescoping section includes an external surface and a tacky coating mounted to the external surface thereof.

6. The cleaning tool of claim 1, wherein the at least one cell includes a width, and the wand portion comprises:

a first telescoping section of a first diameter, the first diameter being less than the cell width, a second telescoping section of a second diameter, the second diameter being less than the first diameter, and a third telescoping section of a third diameter, the third diameter being less than the second diameter, wherein the first, second and third telescoping sections can be movable between a closed collapsed position and an open, extended position, and wherein each of the first, second and third telescoping section includes an external surface and a tacky coating mounted to the external surfaces thereof.

7. The cleaning tool of claim 6, wherein when the telescoping sections are in the closed collapsed position, the third telescoping section is entirely enclosed within the second telescoping section, and the third and second telescoping sections are entirely enclosed within the first telescoping section.

8. The cleaning tool of claim 1, wherein the handle includes a finger grip.

9. The cleaning tool of claim 1, wherein the handle includes finger grips.

10. A cleaning tool for removing debris from a window treatment, the window treatment including at least one cell having a width, the tool comprising:

a handle for gripping the tool, the handle including at least one finger grip;

a wand portion attached to the handle, the wand portion including a first telescoping section of a first diameter, a second telescoping section of a second diameter, and a third telescoping section of a third diameter, the first diameter being less than the cell width, the second diameter being less than the first diameter, and the third diameter being less than the second diameter, wherein the first, second and third telescoping sections can be movable between a closed collapsed position and an open, extended position, and wherein each of the first, second and third telescoping section includes an external surface; and a coating mounted to at least one of the external surfaces of the first, second or third telescoping section, the coating being formed from a tacky material;

wherein when the wand portion is inserted into the at least one cell, the tacky material will touch the debris, causing the debris to be removed from the cell when the wand is removed from the cell.

11. The cleaning tool of claim 10, wherein when the telescoping sections are in the closed collapsed position, the third telescoping section is entirely enclosed within the second telescoping section, and the third and second telescoping sections are entirely enclosed within the first telescoping section.

* * * * *